US006708660B2

(12) United States Patent
Seitz

(10) Patent No.: US 6,708,660 B2
(45) Date of Patent: Mar. 23, 2004

(54) FINGER LEVER OF A VALVE TRAIN OF AN INTERNAL COMBUSTION ENGINE

(75) Inventor: Joachim Seitz, Schlusselfeld (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/456,311

(22) Filed: Jun. 5, 2003

(65) Prior Publication Data

US 2003/0230270 A1 Dec. 18, 2003

(30) Foreign Application Priority Data

Jun. 15, 2002 (DE) ..... 102 26 821

(51) Int. Cl.[7] ..... F01L 1/18

(52) U.S. Cl. ..... 123/90.44; 123/90.41; 123/90.16; 123/198 F

(58) Field of Search ..... 123/90.44, 90.15, 123/90.16, 90.27, 90.31, 90.2, 90.41, 90.47, 198 F

(56) References Cited

U.S. PATENT DOCUMENTS

| | | | | |
|---|---|---|---|---|
| 5,107,803 A | | 4/1992 | Furnivall | 123/90.16 |
| 5,544,626 A | | 8/1996 | Diggs et al. | 123/90.16 |
| 5,619,958 A | * | 4/1997 | Hampton et al. | 123/90.16 |
| 5,653,198 A | * | 8/1997 | Diggs | 123/90.16 |
| 6,314,928 B1 | * | 11/2001 | Baraszu et al. | 123/90.16 |
| 6,321,705 B1 | * | 11/2001 | Fernandez et al. | 123/90.16 |
| 6,439,179 B2 | | 8/2002 | Hendriksma et al. | 123/90.16 |
| 6,532,920 B1 | * | 3/2003 | Sweetnam et al. | 123/90.16 |

FOREIGN PATENT DOCUMENTS

| | | |
|---|---|---|
| DE | 19930574 | 1/2001 |
| DE | 10038917 | 2/2002 |
| EP | 0733783 | 9/1996 |

* cited by examiner

*Primary Examiner*—Thomas Denion
*Assistant Examiner*—Kyle Riddle
(74) *Attorney, Agent, or Firm*—Muserlian, Lucas and Lucas

(57) ABSTRACT

The invention proposes a switchable finger lever (1) comprising a fork-shaped outer lever (2) between whose arms (3*a*, 3*b*) a fork-shaped inner lever (4) is arranged for pivoting relative thereto. The outer lever (2) comprises on an underside (6) in the region of its one closed end (7), a support (8) for the gas exchange valve. The inner lever (4) comprises on the underside (6) on the opposite end (9), a complementary surface (10) for a support element, and on the side of the one end (7), a cam contacting means (12). The latter extends on an axle (13) that is fixed in the outer lever (2). The two levers (2, 4) can be coupled and uncoupled at the opposite end (9) by a transversely displaceable coupling element (5). In this way, a switchable finger lever (1) is obtained that can also be designated as a "buckling" lever and, due to its configuration, has only a small design space requirement. At the same time, the finger lever (1) has only a low mass moment of inertia and can be installed without complicated modifications in existing cylinder heads.

11 Claims, 1 Drawing Sheet

FINGER LEVER OF A VALVE TRAIN OF AN INTERNAL COMBUSTION ENGINE

FIELD OF THE INVENTION

The invention concerns a finger lever of a valve train of an internal combustion engine, said finger lever being switchable to different valve lifts for at least one gas exchange valve and comprising an outer lever having two arms between which an inner lever is arranged for pivoting relative to the outer lever, which inner lever can be coupled to the outer lever by a coupling element, the outer lever comprising on an underside in a region of a closed end, a support for the gas exchange valve, the finger lever comprising on the underside in a region of an opposite end, a complementary surface for a support element, a cam contacting means being arranged on an upper side of the finger lever.

BACKGROUND OF THE INVENTION

A switchable finger lever of the pre-cited type known from DE-OS 27 53 197 likewise includes an outer lever that encloses an inner lever that is pivotable relative to the outer lever. The coupling means is configured as a latch. A drawback of this prior art considered to be generic is that it has a relatively large overall height. Further, it is to be noted that the latch mechanism has a complicated structure and requires a comparatively complex external actuation. This can cause design space problems during mounting of the finger lever.

It is an object of the invention to provide a finger lever of the pre-cited type in which the aforesaid drawbacks are eliminated.

This and other objects and advantages of the invention will become obvious from the following detailed description.

SUMMARY OF THE INVENTION

The invention achieves the above objects by the fact that the outer lever has a fork-shaped open configuration, the complementary surface for the support element is arranged on the inner lever, the inner lever is pivotally fixed on the arms of the outer lever between the closed end and the opposite end, only the inner lever comprises the cam contacting means that is arranged in a region of pivotal mounting of the inner lever, and the transversely displaceable coupling element extends in a region of the opposite end.

This results in the creation of a switchable finger lever that has a relatively simple structure and requires only a comparatively small design space. As a rule, such a finger lever can therefore be incorporated without complicated modifications in existing cylinder heads for non-switchable valve trains. It is to be noted further that the finger lever of the invention is relatively simple to manufacture and, compared to non-switchable finger levers, has only a slightly higher mass moment of inertia.

The proposed finger lever can also be designated as a "buckling" lever because, when the outer lever is disconnected from the inner lever by the coupling element in the region of the opposite end, both points of support of the finger lever are still maintained, the cam contacting means, preferably a rolling-bearing mounted roller, however, sinks towards the cylinder head and the outer lever simultaneously pivots about its fulcrum formed on the end of the gas exchange valve, so that the opposite end of the outer lever is likewise displaced towards the cylinder head.

Preferably, both the inner and the outer lever are made by shaping out of a lightweight material such as sheet metal. This is a further contribution towards an economy of weight, material and manufacturing costs.

To minimize the mass moment of inertia, the coupling element is preferably arranged in the region of the opposite end, for example, above the complementary surface for the support element. This complementary surface is preferably made as a cup-shaped recess on the inner lever in the region of the opposite end.

According to a further proposition of the invention, an axle serves for the pivotal mounting of the inner lever on the outer lever. This axle preferably extends approximately in the region of a central transverse plane of the finger lever and is positioned by a simple fixing method like swaging in bores of the arms of the outer lever.

As already mentioned above, the cam contacting means is a roller mounted on a rolling bearing. According to the invention, this roller is arranged on the inner lever. If need be, the roller can be replaced by a sliding contact surface. It is clear that the finger lever of the invention switches off preferably between zero lift and maximum lift. With slight modifications it can also serve as a change-over switch between valve lifts.

The fork-shaped open configuration of both the inner lever and the outer lever is a further contribution towards a light-weight construction because in each case, only one end has a mass accumulation which, in the case of the outer lever, serves as a support for the gas exchange valve, and in the inner lever, forms the complementary surface for support on a support element.

The support element is preferably a hydraulic support element but a purely mechanical support element is also covered by the invention. Particularly in the case of a hydraulic configuration of the support element which eliminates the need of separate valve lash adjusting measures, hydraulic medium can be routed in a simple manner to the coupling element in the region of the opposite end, in case a hydraulic displacement of the coupling element is desired.

Further features of the invention concern advantageous-embodiments of the lost motion spring. In one embodiment, the axle protrudes on both sides beyond the outer surfaces of the outer lever, and coiled sections of a torsion spring are arranged on the protruding axle stubs. The torsion spring acts through legs on the upper surface of the outer lever and presses through a bridge portion on the inner lever. This assures a sufficiently rapid re-setting of the outer lever relative to the inner lever in the uncoupled mode of the finger lever with a running-off cam flank. Further, the spring force of the lost motion spring is dimensioned so that an undesired influence on the length of the hydraulic support element is avoided with certainty. If necessary, suitable stops can be arranged on the valve train to prevent an excessive relative displacement of the inner and the outer lever away from each other.

In place of the torsion spring being arranged on both sides, it is also possible to arrange it only on one side. Moreover, it is also conceivable to use coil springs and the like that fulfill said lost motion function.

To prevent the switchable finger lever from slipping off from at least one gas exchange valve after mounting and during operation of the internal combustion engine, it is advantageous to arrange guide walls in the region of the one end to surround the valve stem. According to a further proposition of the invention, these guide walls are configured as extensions of the arms of the outer lever and are bent onto the underside of the respective arm. Advantageously, these guide walls are made in one piece with the side walls. However, if necessary, the guide walls can also be made as separate parts and be fixed by suitable methods such as welding and the like on the underside.

The invention will now be described more closely with reference to the appended drawings.

DETAILED DESCRIPTION OF THE DRAWINGS

Figure 1:
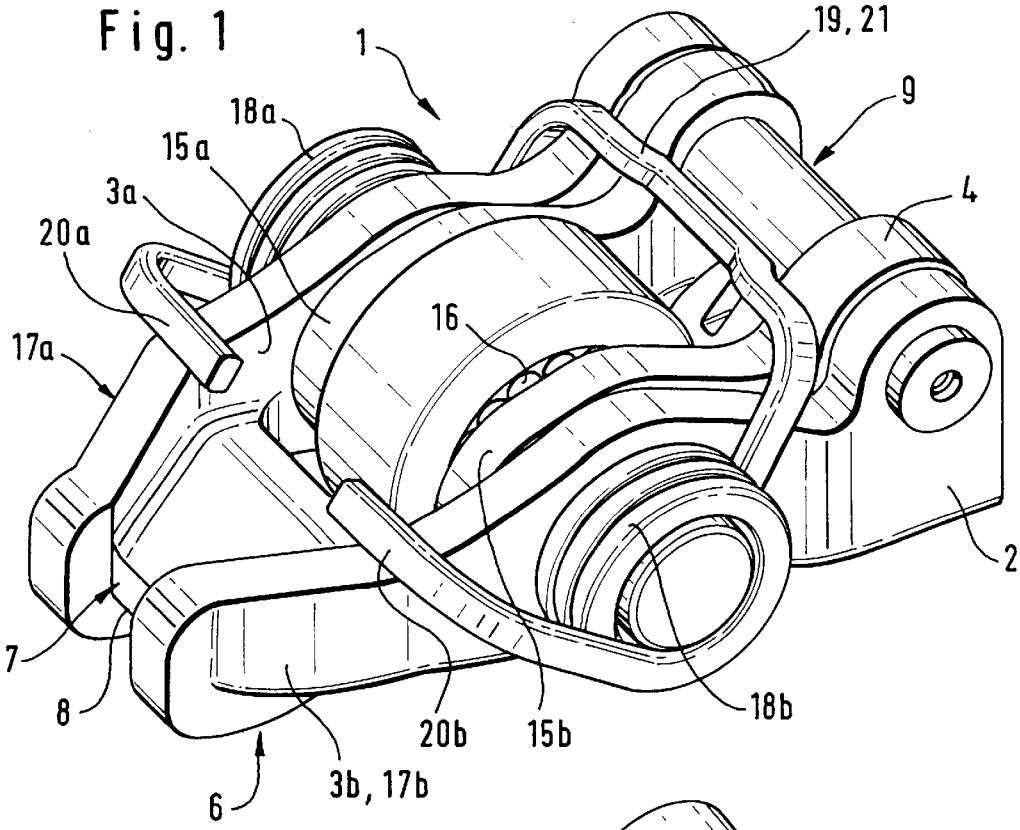
FIG. 1 is a perspective view of a switchable finger lever.

The figures show a switchable finger lever 1 that can also be designated as a "buckling" lever. The finger lever 1 can be switched to different valve lifts for a gas exchange valve, in this case particularly to a zero lift and a maximum lift.

The finger lever 1 comprises a fork-shaped outer lever 2 that has two opposing arms 3*a*, 3*b*. In the region of one end 7, the outer lever 2 has a closed configuration and comprises on its underside 6, a support 8 for a gas exchange valve, not represented in the drawing.

An inner lever 4 likewise having a fork-shaped configuration extends in the space enclosed by the arms 3*a*, 3*b*. The inner lever 4, in its turn, also has two opposing arms 15*a*, 15*b* whose outer surfaces adjoin the inner surfaces of the arms 3*a*, 3*b* of the outer lever 2. The inner lever 4 comprises on the underside 6 in the region of an end 9 situated opposite from said one end 7, a complementary surface 10 for support on a support element. As is quite obvious to a person skilled in the art from the figures, this complementary surface 10 is configured in the present case as a cup-shaped recess on the end 9 of the inner lever 4.

Both lever parts 2, 4 are advantageously made of sheet metal by a shaping method. For forming a valve stem guide, the arms 3*a*, 3*b* are extended in the region of the one end 7 and are advantageously bent onto the underside 6 for forming the guide walls 23*a*, 23*b*. Between these guide walls 23*a*, 23*b*, an end of a gas exchange valve, not shown, is guided on the support 8.

As can be seen in the figures, in its open region facing the one end 7, the inner lever 4 encloses a cam contacting means 12. In the present embodiment, this is configured as a roller mounted on rolling elements 16. Thus, the cam contacting means is arranged on the upper side 11 of the finger lever 1. This cam contacting means is disposed on an axle 13 that extends crosswise through the finger lever 1 and, for example, is swaged in bores 14*a*, 14*b* of the arms 3*a*, 3*b* of the outer lever 2.

It can also be seen that the axle 13 extends with axle stubs laterally out of the arms 3*a*, 3*b*. Each of these axle stubs serves to receive a coiled section 18*a*, 18*b* of a total of one torsion spring (see FIG. 1). The coiled section 18*a* has a protruding leg 20*a* that is bent onto the upper side of the adjoining arm 3*a*. The coiled section 18*b* has a protruding leg 20*b* that is likewise bent onto the upper side of the associated arm 3*b*. As seen in FIG. 1, the legs 20*a*, 20*b* press against the outer lever 2 in anti-clockwise direction. On the inside, the coiled sections 18*a*, 18 are connected by a bridge section 21 extending over the upper sides. This bridge section 21 acts on the inner lever 4 in the vicinity of the opposite end in clockwise direction. In this way, a simple and compact lost motion spring is created (see also introductory part of the specification), but, if necessary, coil or spiral springs can also be used to act on the lever parts 2, 4.

Figure 2:
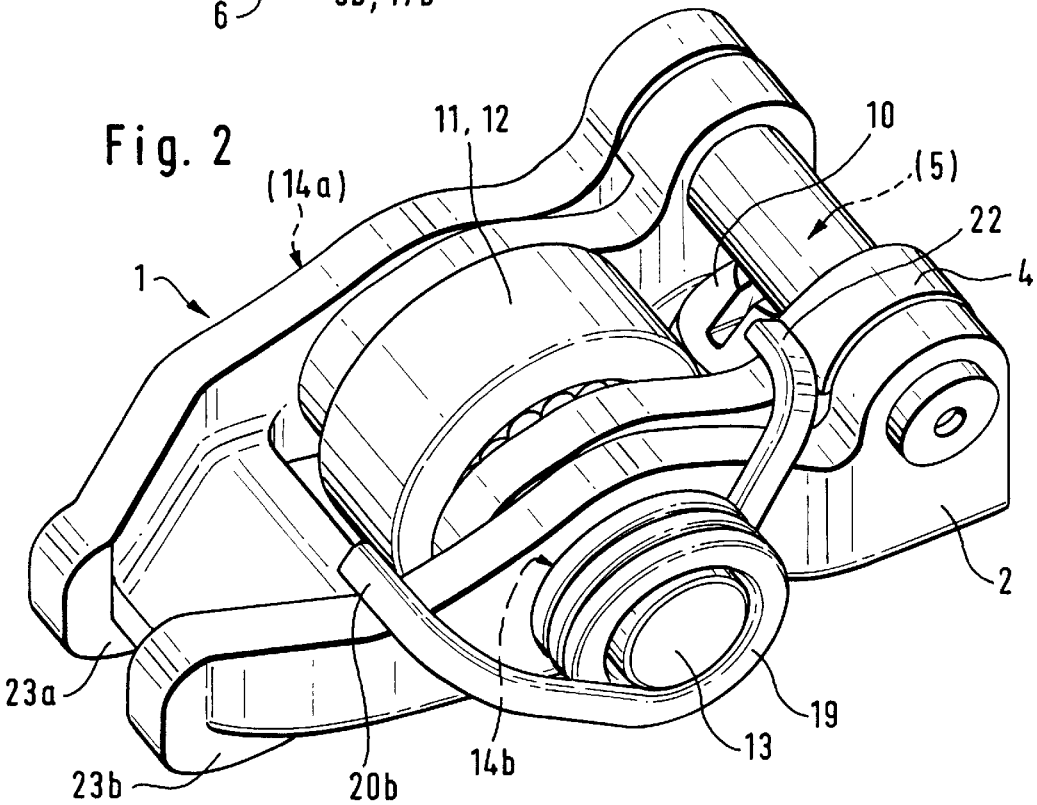
FIG. 2 shows the finger lever of FIG. 1 but with a differently configured torsion spring acting as a lost motion spring.

As illustrated in FIG. 2, the torsion spring 19 may also be "halved".

The coupling element 5, not particularly specified here, is arranged in the region of the opposite end 9, advantageously above the complementary surface 10. The coupling element 5 may be configured, for example, as a stack of slides that can be displaced for coupling and uncoupling in a manner well-known to the person skilled in the art by hydraulic medium supplied from the support element via the complementary surface 10. Precisely due to the fact that the coupling element 5 is arranged in the region of the complementary surface 10, the mass moment of inertia is only slightly higher than in non-switchable finger levers. If necessary, however, the transversely displaceable coupling element 5 may also be disposed in another transverse section of the finger lever 1.

The finger lever 1 of the invention, preferably configured as a "switching-off" lever, can be supplied as an assembled unit so that, as a rule, only slight modifications need to be implemented on existing cylinder heads by the engine manufacturer.

What is claimed is:

1. A finger lever of a valve train of an internal combustion engine, said finger lever being switchable to different valve lifts for at least one as exchange valve and comprising an outer lever having two arms between which an inner lever is arranged for pivoting relative to the outer lever, which inner lever can be coupled to the outer lever by a coupling element, the outer lever comprising on an underside in a region of a closed end, a support for the gas exchange valve, the finger lever comprising on the underside in a region of an opposite end, a complementary surface for a support element, a cam contacting means being arranged on an upper side of the finger lever, wherein the outer lever has a fork-shaped open configuration, the complementary surface for the support is arranged on the inner lever, the inner lever is pivotally fixed on the arms of the outer lever between the closed end and the opposite end, only the inner lever comprises the cam contacting means that is arranged in a region of a pivotal mounting of the inner lever, and the coupling element, that is transversely displaceable, extends in a region of the opposite end, wherein an axle serves for the pivotal mounting of the inner lever on the outer lever, two opposite ends of the axle are arranged in bors of the arms of the outer lever, the inner lever has a fork-shaped configuration open toward the closed end of the outer lever, and the cam contacting means is configured as a rotatable roller that extneds on the axle between arms of the inner lever.

2. A finger lever of claim 1, wherein the cam contacting means configured as a roller is mounted on the axle through rolling elements, typically needle rollers.

3. A finger lever of claim 2 wherein the axle extends beyond outer surfaces of the arms of the outer lever to form protruding axle stubs on each of which a coiled section of a total of one torsion spring is disposed as a lost motion spring having two ends each of which comprises, axially outside, direction, a protruding leg that presses against an upper side of an adjacent one of the two arms of the outer lever, the coiled sections being connected, axially inside, by a bridge portion that extends over the upper sides of the two arms and acts on the inner lever.

4. A finger lever of claim 2, wherein the axle extends beyond an outer surface of at least one of the arms of the outer lever to form a protruding axle stub on which a coiled section of a torsion spring is disposed as a lost motion spring that comprises on an end, axially outside, a protruding leg that presses against an upper side of an adjacent one of the arms of the outer lever, the coiled section merging, axially inside, into a bridge-like extension that extends in transverse direction over the upper side and acts on the inner lever.

5. A finger lever of claim 2, wherein the axle is swaged in the bores of the arms of the outer lever.

6. A finger lever of claim 1, wherein at least one of the inner lever and the outer lever of the finger lever is made of a light-weight material.

7. A finger lever of claim 6, wherein the light-weight is sheet metal and the at least one of the inner lever and the outer lever is fabricated at least substantially by a shaping method.

8. A finger lever of claim 1, wherein the support for the gas exchange valve on the underside is delimited laterally by two guide walls.

9. A finger lever of claim 6, wherein the support for the gas exchange valve on the underside is delimited laterally by two guide walls.

10. A finger lever of claim 7, wherein the support for the gas exchange valve on the underside is delimited laterally by two guide walls.

11. A finger lever of claim 8, wherein the guide walls are made as integrally formed extensions of the arms of the outer lever and are bent onto the underside.

* * * * *